US012595032B2

(12) United States Patent
Kirchhoff et al.

(10) Patent No.: US 12,595,032 B2
(45) Date of Patent: Apr. 7, 2026

(54) SYSTEMS AND METHODS FOR MONITORING BATTERY RANGE FOR AN ELECTRIC MARINE PROPULSION SYSTEM

(71) Applicant: Brunswick Corporation, Mettawa, IL (US)

(72) Inventors: Thomas S. Kirchhoff, Waupaca, WI (US); Sandhya Alla, Fond du Lac, WI (US)

(73) Assignee: Brunswick Corporation, Mettawa, IL (US)

( * ) Notice: Subject to any disclaimer, the term of this patent is extended or adjusted under 35 U.S.C. 154(b) by 185 days.

(21) Appl. No.: 18/407,914

(22) Filed: Jan. 9, 2024

(65) Prior Publication Data

US 2024/0253751 A1 Aug. 1, 2024

Related U.S. Application Data

(60) Provisional application No. 63/482,158, filed on Jan. 30, 2023.

(51) Int. Cl.

| | |
|---|---|
| ***B63B 79/20*** | (2020.01) |
| ***B63B 79/15*** | (2020.01) |
| ***B63B 79/30*** | (2020.01) |
| ***B63B 79/40*** | (2020.01) |
| *B63H 21/00* | (2006.01) |
| *B63H 21/17* | (2006.01) |
| *B63H 25/04* | (2006.01) |

(52) U.S. Cl.

CPC ..... *B63B 79/20* (2020.01); *B63B 79/15* (2020.01); *B63B 79/30* (2020.01); *B63B 79/40* (2020.01); *B63H 2021/003* (2013.01); *B63H 21/17* (2013.01); *B63H 2025/045* (2013.01)

(58) Field of Classification Search

CPC ..... B63H 21/17; B63H 2021/003; B63H 2025/045

See application file for complete search history.

(56) References Cited

U.S. PATENT DOCUMENTS

| | | | | |
|---|---|---|---|---|
| 6,885,919 | B1 | 4/2005 | Wyant et al. | |
| 10,198,005 | B2 | 2/2019 | Arbuckle et al. | |
| 10,845,812 | B2 | 11/2020 | Ward et al. | |
| 2021/0027225 | A1* | 1/2021 | Mikalsen | G06F 3/04847 |
| 2022/0176939 | A1* | 6/2022 | Poll | B60W 10/26 |
| 2023/0219675 | A1 | 7/2023 | Janeczko et al. | |
| 2023/0219676 | A1 | 7/2023 | Kalnins et al. | |

* cited by examiner

*Primary Examiner* — Joan T Goodbody

(74) *Attorney, Agent, or Firm* — Andrus Intellectual Property Law, LLP

(57) ABSTRACT

An electric marine propulsion system includes a power storage system comprising at least one marine battery, an electric marine drive powered by the power storage system, and a control system. The control system is configured to identify at least one environmental vector describing a magnitude and a direction of at least one environmental force impacting a marine vessel, and then calculate a resultant vector based on the at least one environmental vector. A nominal range to empty is then determined based on a charge level of the power storage system, and the system determines an eccentric range based on the resultant vector and the nominal range to empty, wherein the eccentric range represents a range to empty in a plurality of directions around the marine vessel. An eccentric range display is generated on a display device based on the eccentric range.

20 Claims, 13 Drawing Sheets

SYSTEMS AND METHODS FOR MONITORING BATTERY RANGE FOR AN ELECTRIC MARINE PROPULSION SYSTEM

CROSS REFERENCE TO RELATED APPLICATION

This application claims benefit of priority to U.S. Provisional Application No. 63/482,158 filed Jan. 30, 2023, the contents of which is hereby incorporated by reference in its entirety.

FIELD

The present disclosure generally relates to systems and methods for monitoring battery range of a power storage system for a marine propulsion system, and more particularly for determining battery range to account for environmental conditions of the marine environment, such as wind and current.

BACKGROUND

The following U.S. patents and applications provide background information and are incorporated herein by reference, in entirety.

U.S. Pat. No. 6,885,919 discloses a process by which the operator of a marine vessel can invoke the operation of a computer program that investigates various alternatives that can improve the range of the marine vessel. The distance between the current location of the marine vessel and a desired waypoint is determined and compared to a range of the marine vessel which is determined as a function of available fuel, vessel speed, fuel usage rate, and engine speed. The computer program investigates the results that would be achieved, theoretically, from a change in engine speed. Both increases and decreases in engine speed are reviewed and additional theoretical ranges are calculated as a function of those new engine speeds. The operator of the marine vessel is informed when an advantageous change in engine speed is determined.

U.S. Pat. No. 10,198,005 discloses a method for controlling movement of a marine vessel that includes controlling a propulsion device to automatically maneuver the vessel along a track including a series of waypoints, and determining whether the next waypoint is a stopover waypoint at or near which the vessel is to electronically anchor. If the next waypoint is the stopover waypoint, a control module calculates a distance between the vessel and the stopover waypoint. In response to the calculated distance being less than or equal to a threshold distance, the propulsion device's thrust is decreased. In response to sensing that the vessel thereafter slows to a first threshold speed, the vessel's speed is further reduced. In response to sensing that the vessel thereafter slows to a second, lower threshold speed or passes the stopover waypoint, the propulsion device is controlled to maintain the vessel at an anchor point that is at or near the stopover waypoint.

U.S. Publication No. 2023/0219675 discloses a method of controlling an electric marine propulsion system to propel a marine vessel that includes receiving a user-set time, determining a time remaining based on the user-set time, and identifying a battery charge level of a power storage system on the marine vessel. A required battery power is then determined based on the time remaining and the battery charge level, and then an output limit is determined based on the required battery power to enable propelling the marine vessel for the user-set time without recharging the power storage system. The propulsion system is automatically controlled so as not to exceed the output limit.

U.S. Publication No. 2023/0219676 discloses a method of controlling an electric marine propulsion system configured to propel a marine vessel that includes receiving a user-set distance, identifying a battery charge level of a power storage system on a marine vessel and identifying an energy utilization value. An output limit is then determined based on a remaining distance, the battery charge level, and the energy utilization value. The propulsion system is then automatically controlled so as to not exceed the output limit, enabling the marine vessel to travel the user-set distance without recharging the power storage system.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In one aspect of the disclosure, an electric marine propulsion system includes a power storage system comprising at least one marine battery, an electric marine drive powered by the power storage system, and a control system. The control system is configured determine a resultant vector describing a magnitude and a direction of one or more environmental forces impacting the marine vessel. A nominal range to empty is then determined based on a charge level of the power storage system, and the system determines an eccentric range based on the resultant vector and the nominal range to empty, wherein the eccentric range represents a range to empty in a plurality of directions around the marine vessel. An eccentric range display is generated on a display device based on the eccentric range.

In one embodiment, wherein the eccentric range display includes an eccentric range shape representing a distance to empty in the plurality of heading directions from a current position of the marine vessel.

In another embodiment, the eccentric range display includes a circle representing the distance to empty in all directions around the marine vessel. Optionally, the circle represents an asymmetric range around the current position of the marine vessel.

In another embodiment, the eccentric range display represents the eccentric range as an eccentric range shape on a map of an area around the marine vessel.

In another aspect of the disclosure, a method of monitoring a battery range for an electric marine propulsion system comprising a power storage system powering at least one propulsion device, includes identifying a resultant vector describing a magnitude and a direction of one or more environmental forces impacting a marine vessel and determining a nominal range to empty based on a charge level of the power storage system. The method further includes determining an eccentric range based on the resultant vector and the nominal range to empty, wherein the eccentric range represents a range to empty in a plurality of directions around the marine vessel. An eccentric range display is then generated based on the eccentric range and controlling a display device to display the eccentric range display.

In one embodiment, the eccentric range display represents a distance to empty in the plurality of directions, which includes a current heading direction of the marine vessel and a range of heading directions clockwise and counterclockwise from the current heading direction.

In another embodiment, the eccentric range represents the range to empty in at least a current heading direction of the marine vessel and a heading direction 180 degrees from the current heading direction.

In another embodiment, the eccentric range represents the range to empty in at least a current heading direction of the marine vessel, a heading direction 90 degrees from the current heading direction, a heading direction 180 degrees from the current heading direction, and a heading direction 270 degrees from the current heading direction.

In another embodiment, wherein the eccentric range display includes a circle representing the range to empty in all directions around the marine vessel.

In another embodiment, the at least one environmental force impacting the marine vessel includes current and/or wind.

In another embodiment, wherein the resultant vector indicates a net force from a plurality of environmental forces on the marine vessel.

Various other features, objects, and advantages of the invention will be made apparent from the following description taken together with the drawings.

BRIEF DESCRIPTION OF THE DRAWINGS

The accompanying drawings that are incorporated in and constitute a part of this specification illustrate several embodiments of the disclosure and, together with the description, serve to explain the principles of the disclosure. The present disclosure is described with reference to the following figures.

DETAILED DESCRIPTION

Figure 1:
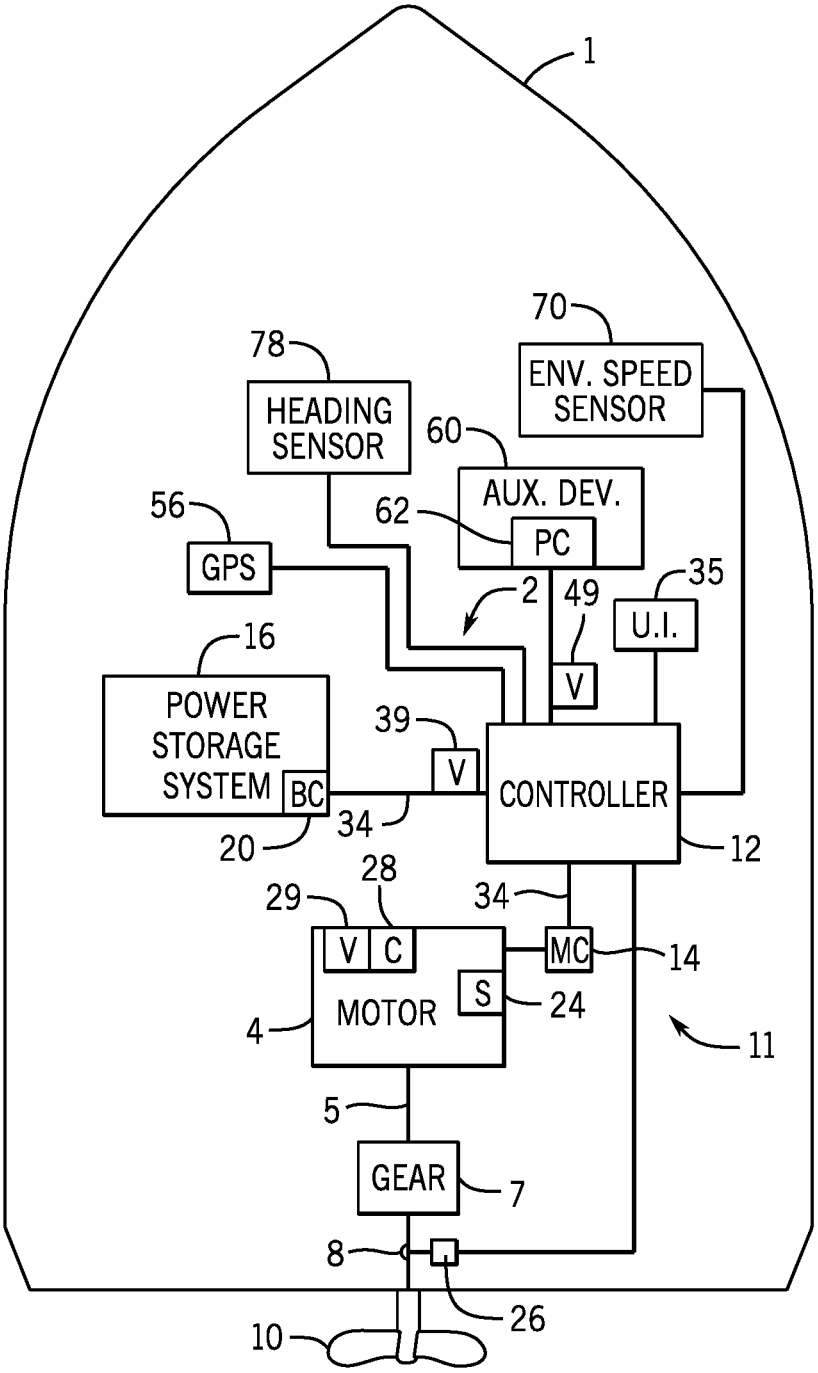
FIG. 1 illustrates a marine vessel having an electric marine propulsion system in accordance with an embodiment of the present disclosure.

In the following sections, detailed descriptions of examples and methods of the disclosure will be given. The description of both preferred and alternative examples, though thorough, are exemplary only, and it is understood to those skilled in the art that variations, modifications, and alterations may be apparent. It is therefore to be understood that the examples do not limit the broadness of the aspects of the underlying disclosure as defined by the claims.

The inventors have recognized a need for systems and methods that account for the environmental conditions around a marine vessel and their impact on the estimated range to empty (RTE), which may be generated as a time to empty (TTE), a distance to empty (DTE), or any value conveying an expected travel time, distance, or other amount based on remaining battery life. These environmental conditions may include wind vectors and water current vectors, for example, using simple speed sensors on the marine vessel or values from external devices such as a GPS device. To provide just a few examples, tracking wind and current directions can be useful for determining and planning optimized routes, calculating optimal propulsion speeds (such as for autonomous control), and predicting energy utilization for traveling certain distances/directions and/or achieving certain speeds.

The inventors have recognized that environmental condition calculation and tracking is particularly needed for electric propulsion, where battery range estimation needs to be improved to account for the net environmental forces caused by elements such as wind and current. Additionally, the inventors recognized that users of electrical propulsion systems often experience a form of "range anxiety" which is particularly evident in marine applications due to the difficulties of being stranded on the water. Thus, the inventors recognized a need for a display system and method for conveying information to the user regarding range in a plurality of heading directions so that they make informed decisions regarding trip planning.

Further, the inventors have recognized that instantaneous power consumption becomes increasingly inaccurate as external environmental forces—such as wind, current, and waves—increase. Environmental forces may increase range in one direction and decrease range when the vessel heads a different direction. For example, the amount of battery power required to propel a vessel five miles on a trip out to open water with a predominant tail wind will be significantly less than the amount of power required to get back to shore with a significant head wind. Accordingly, the inventors have devised the disclosed methods to account for the velocity and magnitude of the environmental forces to improve accuracy of range determinations.

In view of the forgoing challenges and problems in the relevant art, the inventors developed the disclosed method and system for calculating and displaying an eccentric battery range for battery powered propulsion on a marine vessel that accounts for the environmental forces on the vessel. The eccentric range accounts for the effect of the environmental or external forces acting on the marine vessel in each of the various directions, which likely results in a different range calculation in each of the various directions. Namely, the environmental forces may cause the power storage system to expend more energy to propel the vessel in one direction compared to propelling it in another direction.

The eccentric battery range may be calculated in a plurality of directions to provide users with the information needed to provide assurance that the marine vessel will reach its intended destination while accounting for the current power levels marine vessel electrical propulsion system and environmental forces acting on the marine vessel. At least one environmental vector is identified describing a magnitude and direction of an environmental force impacting the vessel. In some embodiments, just a wind vector or just a current vector or just a reading from a GPS are used. In other embodiments, a combination of readings from different environmental sensors are utilized.

The eccentric battery range is conveyed to a user, which may be provided in any number of ways. In one embodiment, an eccentric range shape is determined based on the eccentric range. The eccentric range shape conveys the eccentric range with respect to the vessel's current position in each of the various directions around the marine vessel. For example, the eccentric range shape may be a circle defined based on the eccentric range to empty in various heading directions around the vessel. Where the monitored environmental factor(s) has a non-zero impact on range, the circular range shape is asymmetric with respect to the current vessel position such that the current vessel position is not represented in the center of the circle.

Alternatively or additionally, the eccentric range display may comprise a plurality of numerical indicators of the eccentric range in each of a plurality of directions. The display may be selectable or modified by user input to show the eccentric range and associated information in a selected direction, or a selected subset of directions, which may be in a different direction than the heading current displayed or currently traveled.

Figure 2:
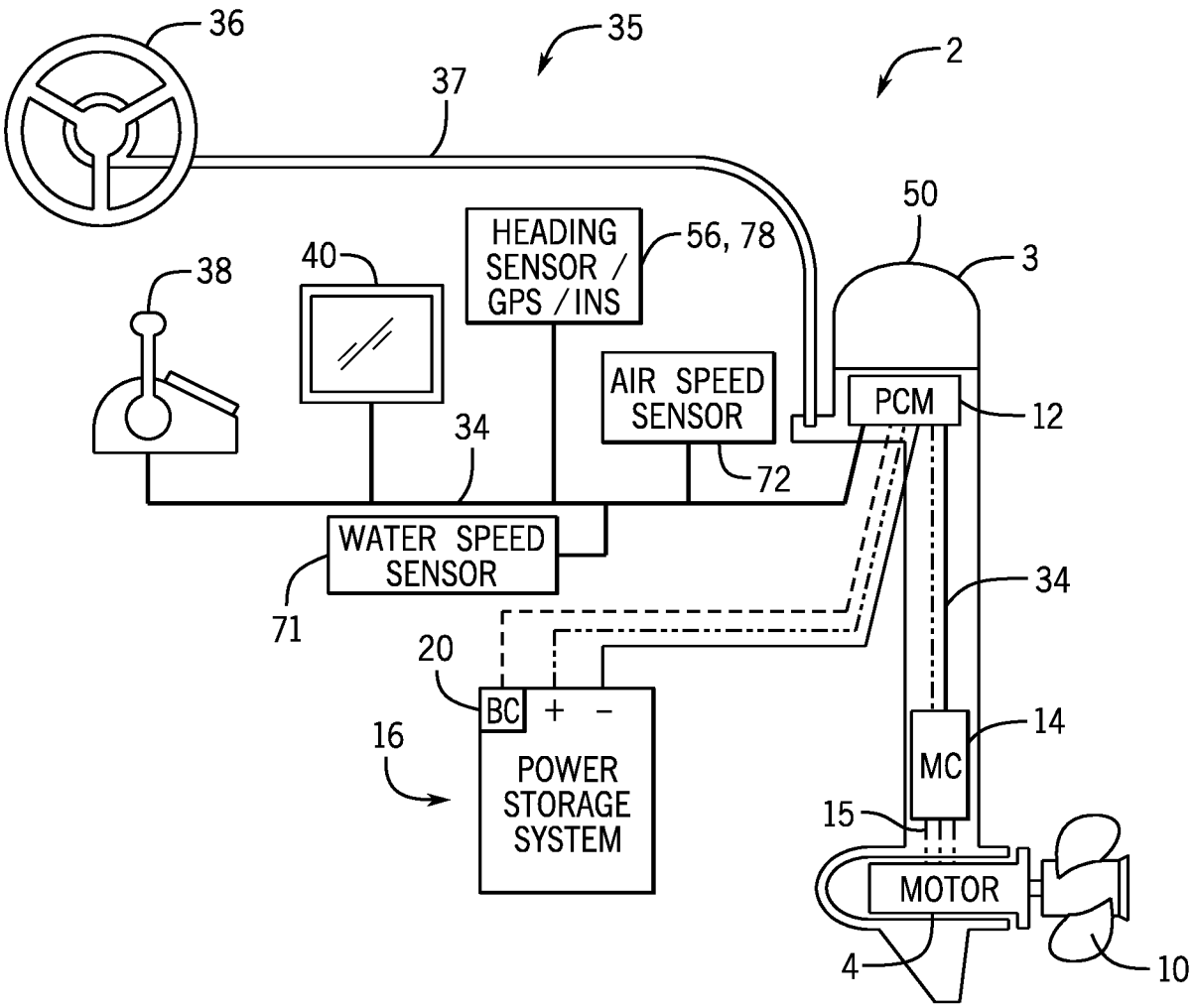
FIG. 2 illustrates an electric marine propulsion system in accordance with another embodiment of the present disclosure.

FIG. 1 depicts an exemplary embodiment of a marine vessel 1 having a marine propulsion system 2 configured to propel the marine vessel. Referring also to FIG. 2, the electric propulsion system 2 includes at least one electric marine drive 3 having an electric motor 4 configured to propel the marine vessel 1 by rotating a propeller 10, as well as a power storage system 16, and a user interface system 35. In the depicted embodiment of FIG. 2, the electric marine propulsion system 2 includes an outboard marine drive 3 having an electric motor 4 housed therein, such as housed within the cowl 50 of the outboard marine drive. A person of ordinary skill in the art will understand in view of the present disclosure that the marine propulsion system 2 may include other marine drive 3 configurations, such as inboard drives (as represented in FIG. 1) or stern drives. The electric marine drive 3 may be powered by a scalable power storage device 16, such as a marine battery or bank of batteries.

The electric marine propulsion system 2 may include one or a plurality of electric marine drives 3, each comprising at least one electric motor 4 configured to rotate a propulsor, or propeller 10. The motor 4 may be, for example, a brushless electric motor, such as a brushless DC motor. In other embodiments, the electric motor may be a DC brushed motor, an AC brushless motor, a direct drive, a permanent magnet synchronous motor, an induction motor, or any other device that converts electric power to rotational motion. In certain embodiments, the electric motor 4 includes a rotor and a stator in a known configuration.

The electric motor 4 is electrically connected to and powered by a power storage system 16. The power storage system 16 stores energy for powering the electric motor 4. Various power storage devices and systems are known in the relevant art. The power storage system 16 may be a battery system configured to receive one or more batteries or banks of batteries of different varieties including OEM batteries, third party batteries, or both. For example, the power storage system 16 may include one or more lithium-ion (LI) battery systems, each LI battery comprised of multiple battery cells. In other embodiments, the power storage system 16 may include one or more lead-acid batteries, fuel cells, flow batteries, ultracapacitors, and/or other devices capable of storing and outputting electric energy.

The electric motor 4 is operably connected to the propeller 10 and configured to rotate the propeller 10. As will be known to the ordinary skilled person in the relevant art, the propeller 10 may include one or more propellers, impellers, or other propulsor devices and that the term "propeller" may be used to refer to all such devices. In certain embodiments, such as that represented in FIG. 1, the electric motor 4 may be connected and configured to rotate the propeller 10 through a gear system 7 or a transmission. In such an embodiment, the gear system 7 translates rotation of the motor output shaft 5 to the propeller shaft 8 to adjust conversion of the rotation and/or to disconnect the propeller shaft 8 from the drive shaft 5, as is sometimes referred to in the art as a "neutral" position where rotation of the drive shaft 5 is not translated to the propeller shaft 8. Various gear systems 7, or transmissions, are well known in the relevant art. In other embodiments, the electric motor 4 may directly connect to the propeller shaft 8 such that rotation of the drive shaft 5 is directly transmitted to the propeller shaft 8 at a constant and fixed ratio.

A control system 11 controls the electric marine propulsion system 2, wherein the control system 11 may include a plurality of control devices, or controllers, configured to cooperate to provide the method of controlling the electric marine propulsion system described herein. For example, the control system 11 may include a central controller 12, and one or more motor controllers, trim controllers, steering controllers, battery controllers, power controllers, navigation controllers, etc. communicatively connected, such as by a communication bus or other communication link. A person of ordinary skill in the art will understand in view of the present disclosure that other control arrangements could be implemented and are within the scope of the present disclosure, and that the control functions described herein may be combined into a single controller or divided into any number of a plurality of distributed controllers that are communicatively connected.

Each controller may comprise a processor and a storage device, or memory, configured to store software and/or data utilized for controlling and/or tracking operation of the electric propulsion system 2. The memory may include volatile and/or non-volatile systems and may include removable and/or non-removable media implemented in any method or technology for storing of information. The storage media may include non-transitory and/or transitory storage media, including random access memory, read only memory, or any other medium which can be used to store information and be accessed by an instruction execution system, for example. Such information may include a command table containing a set of adjustment commands based on measured or calculated values. An input/output (I/O) system facilitates communication between the control system 11 and connected devices.

Each electric motor 4 may be associated with a motor controller 14 configured to control power to the electric motor, such as to the stator winding thereof. The motor controller 14 is configured to control the function and output of the electric motor 4, such as controlling the torque outputted by the motor 4, the rotational speed of the motor 4, as well as the input current, voltage, and power supplied to and utilized by the motor 4. In one arrangement, the motor controller 14 controls the current delivered to the stator windings via the leads 15, which input electrical energy to the electric motor to induce and control rotation of the rotor.

In certain embodiments, various sensing devices 24, 26, 28, 29, 39, 49 may be configured to communicate with a local controller, such as the motor controller 14 or power controller 62, and in other embodiments the sensors 24, 26, 28, 29, 39, 49 may communicate with the central controller 12 and the motor controller 14 may be eliminated. A GPS system 56 may also be configured to determine a current global position of the vessel, track vessel position over time, determine vessel speed over ground, and/or determine the vessels' direction of travel, or heading direction, and to provide such information to the controller 12. Alternatively, instead of a GPS system 56, the vessel may include a global navigation satellite system (GNSS), or a GNSS/INS (inertial navigation system). Alternatively or additionally, the vessel 1 may be equipped with a heading sensor 78 configured to measure the vessels' heading. The vessel heading sensor 78 may include a compass, a gyroscope, an accelerometer, and/or other elements configured to measure vessel position and/or movement. For example, the heading sensor may be part of an inertial measurement unit (IMU) or similar, such as IMU having a solid state, rate gyro electronic compass that detects the direction of the earth's magnetic field using solid state magnetometers and indicates the vessel heading relative to magnetic north.

Additionally, one or more environmental sensors 70 are configured to measure air and/or water speed around the marine vessel and such information may be provided to the controller 12. Referring also to FIG. 2, the environmental sensors include a water speed sensor 71 and an air speed sensor 72. The water speed sensor 71 may be a unidirectional sensor, such as a pitot tube or a paddle wheel, mounted to the hull under the waterline and configured to measure water speed in the direction of travel of the vessel and with respect to the vessel's hull, and thus to measure the vessel's speed-over-water. Similarly, the air speed sensor 72 may be a unidirectional sensor, such as a pitot tube or a paddle wheel, mounted to the vessel above the waterline, such as at a location at or near the highest point on the vessel that will not be protected or obstructed from measuring the air flow over the vessel. The air speed sensor 72 may be configured to measure air speed in the direction of travel of the vessel and with respect to the vessel, and thus to measure the vessel's speed-through-air.

In some embodiments, a plurality of air speed sensors 72 may be located at different locations on the marine vessel 1, wherein each is configured to measure air speed at its respective location. For example, one air speed sensor may be located at or near the front of the bow and a second air speed sensor may be located at or near the highest point on the marine vessel, such as atop the Bimini top or on the antennae tower. An aggregate airspeed value can then be determined based on the plurality of local measurements on the vessel, such as by averaging the plurality of local measurements or using other calculation techniques to determine a filtered airspeed value that is less influenced by local air disturbances, measurement error, etc. Similarly, an aggregate water speed value may be determined based on measurements from a plurality of water speed sensors 71 mounted at different locations on the vessel hull below the waterline.

Controllers 12 and 14 (and or the various sensors and systems) may be configured to communicate via a common communication link 34. The one or more communication links may be a wired link, such as a bus, or may be a wireless communication link, such as via any wireless protocol. In one embodiment, the communication link 34 is a CAN bus (e.g., configured as a CAN Kingdom Network), or alternatively may be a LIN bus. In some embodiments, one or more devices may be connected by dedicated communication link, such as a dedicated communication bus or link between controllers 12 and 14.

Sensors may be configured to sense the power, including the current and voltage, delivered to the motor 4 and/or voltage sensed at other locations within the system. For example, a plurality of voltage sensors 29, 39, 49 may be configured to sense voltage at various locations within the system. Voltage sensor 29 may be configured to sense the input voltage to the motor 4 and a current sensor 28 may be configured to measure input current to the motor 4. Accordingly, power delivered to the motor 4 can be calculated and such value can be used for monitoring and controlling the electric propulsion system 2, including for monitoring and controlling the motor 4 and ensuring the system 2 is operating within the capabilities of the electric motor 4. Alternatively or additionally, the system 2 may include a voltage sensor 39 at or near the connection point of the vessel system(s) to the power storage system 16 to sense the voltage at the location(s) of power input. Alternatively or additionally, a voltage sensor 49, or multiple voltage sensors, may be located to measure voltage powering one or more auxiliary devices 60. In certain embodiments, the voltage sensor 49 may comprise part of the power controller 62 for the auxiliary power system and/or may be configured to measure voltage at one or more converters, such as a DC-DC converter powering auxiliary electronics or other auxiliary devices.

In the depicted example, the current sensor 28 and voltage sensor 29 may be communicatively connected to the motor controller 14 to provide measurement of the voltage supplied to the motor and current supplied to the motor. Other voltage sensor(s) 39, 49 may be configured to provide voltage measurement outputs to the controller 12 and/or the motor controller 14. The motor controller 14 is configured to provide appropriate current and or voltage to meet the demand for controlling the motor 4. For example, a demand input may be received at the motor controller 14 from the central controller 12, such as based on an operator demand at a helm input device, such as the throttle lever 38. In certain embodiments, the motor controller 14, voltage sensor 28, and current sensor 29 may be integrated into a housing of the electric motor 4, and in other embodiments the motor controller 14 may be separately housed.

Various other sensors may be configured to measure and report parameters of the electric motor 4. For example, the electric motor 4 may include means for measuring and or determining the torque, rotation speed (motor speed), current, voltage, temperature, vibration, or any other parameter. In the depicted example, the electric motor 4 includes a speed sensor 24 configured to measure a rotational speed of the motor 4 (motor RPM). Alternatively or additionally, propeller speed sensor 26 may be configured to measure a rotational speed of the propeller 10. For example, the propeller speed sensor 26 and/or the motor speed sensor 24 may be a Hall Effect sensor or other rotation sensor, such as using capacitive or inductive measuring techniques. In certain embodiments, one or more of the parameters, such as the speed, torque, or power to the electric motor 4, may be calculated based on other measured parameters or characteristics. For example, the torque may be calculated based on power characteristics in relation to the rotation speed of the electric motor, for example.

At least one battery controller 20 is configured to monitor the power storage system 16. For example, the battery or each of a plurality of batteries in the power storage system 16 may have an associated a battery controller 20 configured to monitor various battery parameters, such as current, voltage, temperature, etc. and communicate those parameters within the control system, such as to the central controller 12 and/or the motor controller 14. For instance, each battery controller may be configured to periodically determine and communicate via the communication link 34 each of a charge level for the battery (e.g., battery state of charge and/or battery voltage), battery temperature, and battery state of health for each of its associated batteries, battery connection and operation status, as well as other parameters and operation information for the battery.

The central controller 12, which in the embodiment shown in FIG. 2 is a propulsion control module (PCM), communicates with the motor controller 14 and the battery controller 20 via communication link 34, such as a CAN bus. The controller also receives input from and/or communicates with one or more user interface devices in the user interface system 35 via the communication link, which in some embodiments may be the same communication link as utilized for communication between the controllers 12 and 14 or may be a separate communication link. The user interface devices in the exemplary embodiment include a throttle lever 38 and a display device 40. In various embodiments, the display device 40 may be, for example, part of an onboard management system, such as the VesselView™ by Mercury Marine of Fond du Lac, Wisconsin. Alternatively or additionally, the user interface devices may include a user's mobile device, such as a cell phone or other portable computing device running an application, such as VesselView Mobile™, configured to communicate with one or more controllers in the control system 11. A steering wheel 36 is provided, which in some embodiments may communicate with the controller 12 or other control device in the control system 11 to effectuate steering control over the marine drive 3, which is well-known and typically referred to as a steer-by-wire arrangement. Alternatively, as in the depicted embodiment, the steering wheel 36 is a wired steering arrangement where the steering wheel 36 is connected to a steering actuator that steers the marine drive 3 by a steering cable 37. Other steering arrangements, such as various wired and steer-by-wire arrangements, are well-known in the art and could alternatively be implemented.

The various parameters of the electric propulsion system are utilized for providing user-controlled or automatically effectuated vessel power control functionality appropriate for optimizing power usage. The system may be configured to control power usage by the electric propulsion system 2, for example so that power available and utilized to effectuate propulsion remains within calculated limits to provide consistent propulsion and operate the motors within the rated operation parameters. The system may be configured to operate in a variety of user-selectable power modes, or in various power modes that may be automatically selected by the control system 11 based on sensed parameters and/or operating conditions of the propulsion system 2.

The power storage system 16 may further be configured to power auxiliary devices 60 on the marine vessel 1 that are not part of the propulsion system 2. For example, the auxiliary devices may include a bilge pump, cabin lights, a stereo system or other entertainment devices on the vessel, a water heater, a refrigerator, an air conditioner or other climate/comfort control devices on the vessel, communication systems, navigation systems, or the like. Some or all these accessory devices are sometimes referred to as a "house load" and may consume a substantial amount of battery power. Additionally, other non-motor loads may be powered by the power storage system 16, such as steering, motor trim, trim tabs, and other devices relating to steering and/or vessel orientation control.

The power consumption by some or all of the auxiliary devices and/or non-motor loads may be monitored and/or controllable, such as by a power controller 62 associated with each controlled auxiliary device or a group of auxiliary devices (FIG. 1). The power controller 62 is communicatively connected to the controller 12 or is otherwise communicating with one or more controllers in the control system 11, in order to monitor and/or control power consumption by such auxiliary devices. For example, the power controller 62 may be configured to communicate with one or more power monitoring or other control devices via CAN bus or LIN bus, and to then control operation of the auxiliary device and/or power delivery to the auxiliary device according to received instructions. For instance, the system may be configured to reduce power delivery or prevent change in power deliver to the device(s) 60 during certain measurement periods, or to selectively turn off the auxiliary device(s) 60 by turning on or off power delivery to the device(s) 60 associated with the power controller 62 during the measurement period. For example, the power controller 62 for one or a set of auxiliary devices may include a battery switch controlling power thereto. The control system 11 may thus include digital switching system configured to control power to the various auxiliary devices, such as a CZone Control and Monitoring system by Power Products, LLC of Menomonee Falls, WI. Other examples of power control arrangements are further exemplified and described at U.S. application Ser. Nos. 17/009,412 and 16/923,866, which are each incorporated herein by reference in its entirety.

As described above, the disclosed method and system are configured to monitor battery range based on environmental conditions, such as to account for the effects of wind and current directions and magnitudes. In certain embodiments, the control system 11 may be equipped and configured to measure wind and current speeds (such as the system exemplified in FIG. 1) and determine one or more of the environmental vectors internally. Alternatively, the control system 11 may be configured to access the wind and/or current vector information externally, such as to access weather map data based on GPS information of the vessel and/or the vessel's travel path to the trip end location. In another example, the system is configured sense the wind and/or current speeds in environment around the marine vessel and to determine wind and/or current vectors for one or more areas that the vessel occupies.

Figure 3:
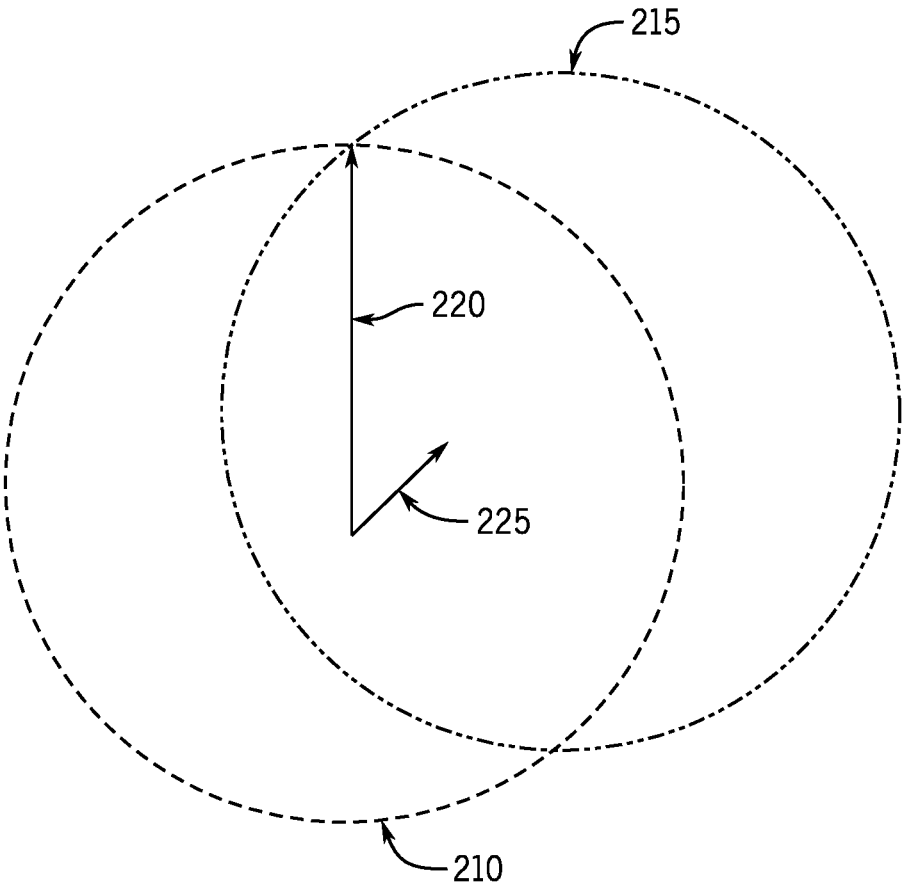
FIG. 3-6 are schematic depictions of exemplary eccentric range calculation steps for an electric marine propulsion system in accordance with embodiments of the present disclosure.

Referring now to FIG. 3, a schematic depiction of an exemplary eccentric range calculation for an electric marine propulsion system 2 is illustrated, based upon which the eccentric range is generated. Eccentric range, as used herein, refers to a range determination in each of a plurality of directions with respect to the marine vessel. The eccentric range accounts for the effect of the net environmental or external forces acting on the marine vessel in each of the various directions, which likely results in a different range calculation for each of the various directions. Namely, the environmental forces may cause the power storage system to expend more energy to propel the vessel in one direction compared to propelling it in another direction. In some implementations, the eccentric range may comprise a shape such as a circle or oval, as non-limiting examples, or at least a portion of a shape, such as an arc length, that provides a visual indication of the marine vessel's range capacity in various heading directions.

The eccentric range may be represented on an eccentric range display that visually conveys the directional range information to the user. For example, an icon representing the vessel may be placed relative to a shape representing the eccentric range. Where the eccentric range includes varying ranges in different directions, the vessel icon will be depicted at an off-center location within the eccentric range shape so as to depict the impact of the environmental or external factors on the vessel's range in the various heading directions. If the net environmental forces are equal in all directions at a given time, then the display may be arranged to place the vessel icon centered with respect to the shape representing the eccentric range.

FIG. 3 illustrates the difference between a circle calculated based on the nominal range, which is calculated based on information determined at a given time when the vessel is headed in a single vessel heading direction, and a circle determined based on an eccentric range which accounts for the effects of environmental factors. Nominal range circle 210 is generated based on a nominal range to empty (RTE) calculation or estimation based on the present power utilization of the propulsion system and/or the current charge level of the power storage system 16. Thus, it shows an equal range in every direction around the marine vessel. In some embodiments, the nominal range circle 210 may comprise a calculation based on the present power consumption rate and the charge level of the power storage system 16 (comprising one or more batteries), providing an estimate of when the present level(s) will be completely expended or reach a threshold discharge level.

The eccentric range circle 215 represents the range in a plurality of directions and takes into account the differing effects of environmental forces 65 in different directions when calculating the RTE estimation. In some embodiments, the calculations used to determine the eccentric range, and thus the eccentric range shape, may be based on a net environmental force in each of several directions determined based on information measured by one or more environmental sensors 70 on the vessel, such as measuring each of wind and current. Alternatively, and as explained in more detail below, the eccentric range may be calculated based on speed over ground (SOG) values measured by a GPS system 56 in each of a plurality of directions. The SOG measurements take into account the net effect of the environmental forces 65 on the vessel.

In one embodiment, the eccentric range may be calculated based on a plurality of SOG measurements taken when the vessel is traveling at a constant trajectory in each of a plurality of directions. Constant trajectory refers to a substantially constant magnitude or rate of the marine vessel's propulsion output and a constant heading or a constant change in direction of the marine vessel. For example, the constant trajectory may be a substantially constant rate of power consumption, torque, rotational speed (e.g., motor speed or propeller speed), current, voltage, a neutral motor state, or any other parameter indicative of a substantially constant propulsion output.

In some embodiments, the constant trajectory may be labeled as 'constant' after maintaining a steady state, or being within a tight threshold range, for a predetermined amount of time. For instance, the predetermined amount of time may be one second, 10 seconds, 60 seconds, or 90 seconds, as a list of non-limiting examples. In some embodiments, the constant trajectory may be indicated by the control system 11. In some implementations, the constant trajectory may be a constant propulsion output value and constant heading or constant change in direction measured for a minimum predetermined amount of time. Arrow 220 represents the calculated RTE in the current heading direction, shown as being north, at a present constant trajectory. Nominal range circle 210 is calculated based on the RTE in the current heading direction.

As an example, the constant trajectory may be a substantially uniform propulsion output. This trajectory may continue to be classified as a constant trajectory until at least one measured variable changes, such as the changing of the propulsion output in response to a throttle adjustment or a change in heading. The propulsion output utilized for identifying the constant trajectory may be, for example, power utilization of the propulsion system, motor RPM, motor current, motor torque, propeller RPM, or any other parameter indicative of propulsion output by the propulsion system 2.

In some embodiments, the eccentric range calculations may comprise determining a resultant vector 225 representing one or more environmental forces acting on the marine vessel 1. The resultant vector 225 may be determined based on information received from one or more environmental sensors 70, the GPS system 56, based on weather data or current maps, and/or a combination thereof. Exemplary methods and systems for determining the resultant vector 225 are described herein. Additional methods and systems for determining the resultant vector 225 are shown and described in U.S. patent application Ser. No. 18/489,280, which is hereby incorporated herein by reference in its entirety.

The resultant vector is then used to determine the calculate range values, such as a distance to empty (DTE) and/or a time to empty (TTE), in a plurality of directions that account for the environmental forces. For example, a headwind that might increase the amount of power required from the power storage system 16 to maintain a predetermined power utilization. Alternatively, a tailwind may decrease the power required from the power storage system 16 to maintain a predetermined power utilization. The resultant vector 225 represents these effects. The eccentric range shape 215, which here is a circle, is determined based on the resultant vector, which will impact its size, shape, and placement with respect to the marker representing the current vessel position.

The resultant vector 225 may be based on information received from one or more positional datapoints 260. The information collected at the one or more positional datapoints 260 may be received from a GPS system 56 at a predetermined frequency, such as every second. In addition to position, the positional datapoints 260 received by the GPS system 56 may comprise a heading and speed over ground. In some aspects, the eccentric range shape 215 may be imposed upon a map from the GPS system 56 to form an eccentric range display that establishes a relationship between the calculated eccentric range shape 215 and physical destinations that may or may or may not be within the confines of the eccentric range shape 215.

Figure 4B:
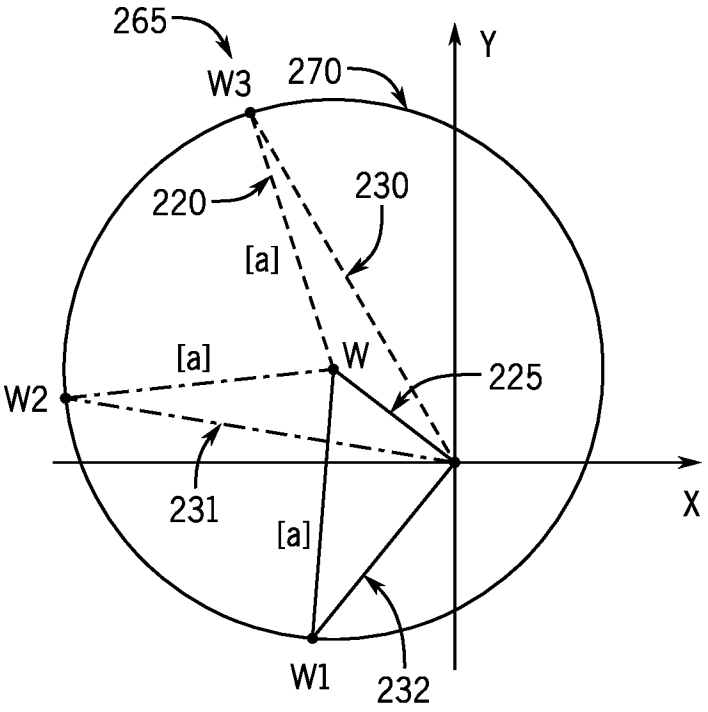
Figure 4A:
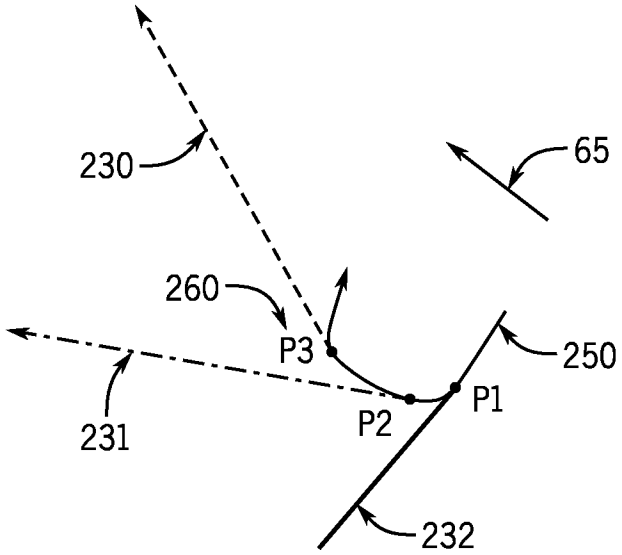

Referring now to FIGS. 4A-B, exemplary eccentric range calculations for an electric marine propulsion system are illustrated. In FIG. 4A, the eccentric range calculations may comprise a movement path 250. In one embodiment, the movement path 250 may determine the location and frequency of recorded positional datapoints 260. The movement path 250 may determine when positional datapoints 260 are recorded, which may be handled by the control system 11.

For example, in order to provide enough data to form a proper eccentric range, the movement path 250 may require at least two changes in direction. Changes in direction may provide more variation in the measured positional datapoints 260, thereby providing a better averaged value of environmental forces 65 exerted on the marine vessel 1 and the associated resultant vector 225 that helps form the eccentric range shape 215. For example, if the marine vessel 1 heading is distributed over a 60 to 90 degree arc then the direction and magnitude of the affecting environmental forces 65 may be calculated at less than approximately 20% error, which would account for the variation of forces such as windspeed and wind direction that may be caused by gusts.

The positional datapoints 260 (e.g., P1, P2, P3) may be recorded when the movement path 250 is at a constant propulsion output for at least a predetermined minimum predetermined amount of time. The constant propulsion output may maintain a constant change of direction or a constant heading. As an example, the marine vessel 1 may execute a constant turn for at least 60 seconds, thereby providing enough time for the movement path 250 of the constant turn to be termed as a constant trajectory for the purpose of recording positional datapoints 260. As another example, the marine vessel 1 may maintain the same heading for at least 90 seconds, thereby initiating the recording of positional datapoints 260. The movement path 250 may be monitored by one or more sensing devices 24, 26, 28, 29, 39. The positional datapoints 260 recorded along the movement path 250 may contain the velocity magnitude and the heading at that location on the movement path, such as at location P1 in the figure. In some implementations, recording the positional datapoints 260 may be activated by time intervals, changes in heading, or a satisfied time threshold wherein a constant velocity is maintained, as a list of non-limiting examples.

The positional datapoints 260 may comprise a tangential vector 230, 231, 232. Tangential vector 230, 231, 232, as used herein, refers to an instantaneous measurement of speed and heading at a given time. In some embodiments, the speed of the tangential vector 230, 231, 232 can be separated into components such as x and y coordinates.

The environmental forces 65 act on the marine vessel 1 while the marine vessel 1 is on the movement path 250, which can be determined by comparing the tangential vectors. Referring now to FIG. 4B, the tangential vectors 230, 231, 232 may be plotted on an XY velocity schematic. By setting the tail end of the tangential vector 230, 231, 232 at the origin of the XY plane, the head of each tangential vector 230, 231, 232 extends to the X and Y values of the velocity of the tangential vector (found at points v1, v2, and v3). The constant trajectory arrow 220 represents the X and Y values of the constant trajectory speed at the time the tangential vectors 230, 231, 232 are recorded. Because the speed of the constant trajectory was the same as the speed of the tangential vector 230, 231, 232 at the time the tangential vector is recorded, the heads of the constant trajectory arrow 220 and the tangential vector 230, 231, 232 may share a common point on the XY velocity plane. It is important to emphasize that the velocity of the constant trajectory does not have to be constant. Rather, the substantially constant propulsion output may be measured by another metric, such as RPM, which allows the constant trajectory arrow 220 to have the same velocity magnitude as the tangential vector 230, 231, 232 (and thereby can share the same velocity datapoint 265), such as points v1, v2, and v3 in the figure.

Because the velocity magnitude of the tangential vectors 230, 231, 232 may differ significantly, a best fit circle 270 may be used to estimate an approximate average of speeds for the tangential vectors 230, 231, 232. This best fit circle 270 may allow for the calculations necessary to deduce the resultant vector 225, which represents the net environmental force and magnitude applied by the environmental forces 65. This net environmental force is calculated using the semi-formed triangles from each of the tangential vectors 230, 231, 232 and their accompanying constant trajectory, as depicted within the figure.

Because of the shared velocity datapoints 265 of the tangential vectors 230, 231, 232 and the constant trajectory arrow 220, computational methods can be used to calculate the resultant vector 225. In some aspects, the computations may occur in the control system 11 and be used to calculate the eccentric range. The computational methods may comprise vector manipulation, such as vector addition, to solve for the value of the resultant vector 225.

By mapping the tangential vectors 230, 231, 232, the constant trajectory, and resultant vector, or any combination thereof, relative to the origin of the velocity XY plane, angles of the vectors may be known or solved for, thereby providing additional methods of solving for the resultant vector 225. At least one of computational methods of solving for the resultant vector 225 may comprise trigonometry, wherein the known angles and magnitudes of the tangential vectors 230, 231, 232 and the constant trajectory may provide the solution for the magnitude and direction of the resultant vector 225.

In some aspects, as a result of the combination of the constant trajectory and the tangential vectors 230, 231, 232, the radius of the best fit circle 270 may be equivalent to the magnitude of the constant trajectory. The magnitude and direction of the resultant vector 225 may be equivalent to the distance and direction from the origin of the XY velocity axis to the center of the best fit circle 270 that best fits the majority of the velocity datapoints 265.

Figure 5:
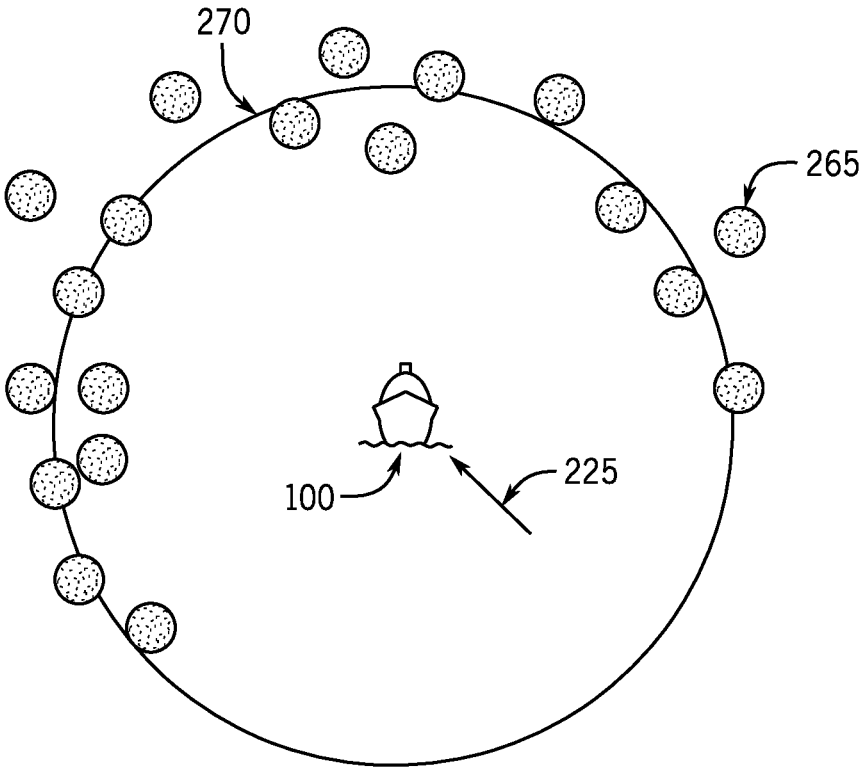

Referring now to FIG. 5, eccentric range calculations for an electric marine propulsion system are further illustrated, which are based on the plurality of velocity datapoints 265 described in FIG. 4A-B. Increasing the quantity of velocity datapoints 265 improves the accuracy of the direction and magnitude of the resultant vector 225. The quantity of velocity datapoints 265 may increase as a function of time, change of direction, or change in a constant trajectory as a non-limiting list of examples. As an example, the eccentric range calculations may continue to store and plot velocity datapoints 265 at a predetermined rate over a defined period of time, such as a rate of every 30 seconds over a several minute period of time. The increased density of plotted velocity datapoints 265 may improve the accuracy of the best fit circle 270 and the resultant vector 225. It should be noted that FIG. 5, or aspects thereof, may also be presented to the user as part of an eccentric range display, which is described in more detail below.

The fit of the best fit circle 270 may require circular regression, such as the Kasa fit method, as a non-limiting example. As another example, the Taubin-based Newton method might be used to increase real-time computing speed without sacrificing numerical stability, as long as the data does not require matrix functions. This method may also be used based on the plotting accuracy as the best algebraic fit method or when the arc length of the velocity datapoints 265 is relatively small. In addition to the 'fit' produced by the employed method, the mean squared error of the predicted center and radius of the best fit circle 270 may be calculated to ensure the accuracy of the best fit circle 270 and its accompanying resultant vector 225.

Figure 6:
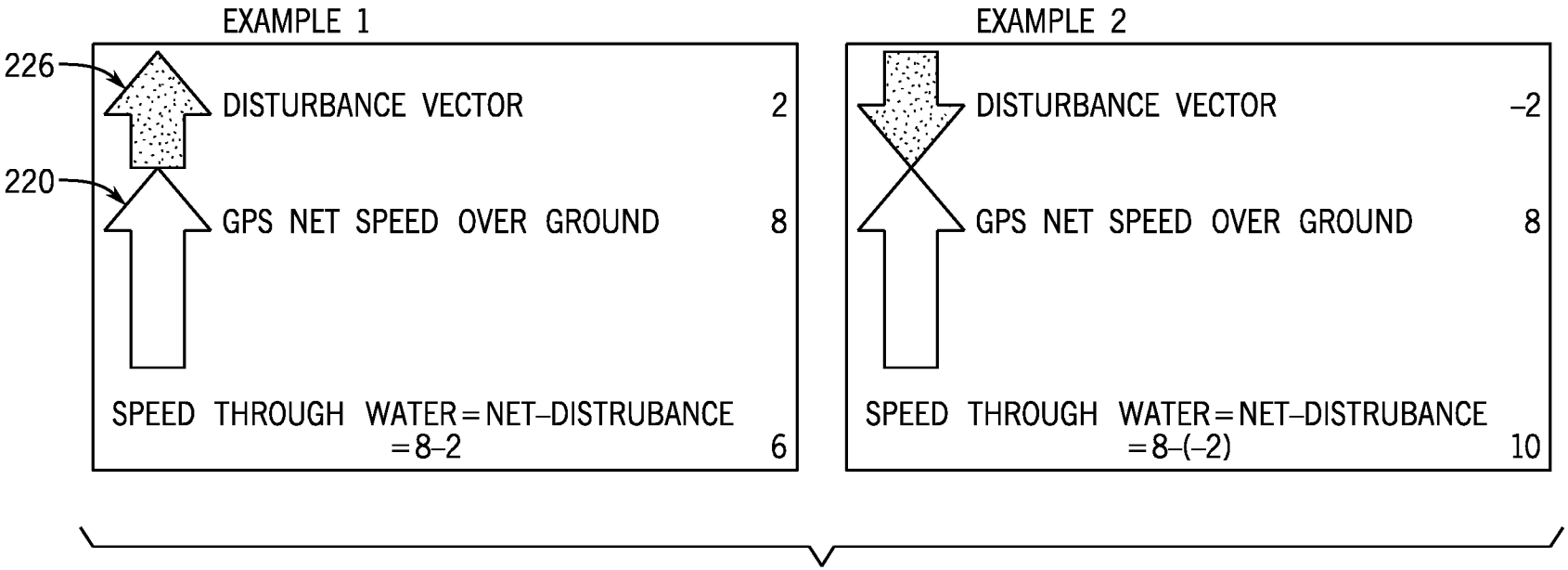

As illustrated in FIG. 6, the eccentric range is calculated based on the resultant vector 225, or in other embodiments may be based on any disturbance vector 226 value representing the total disturbance generated by the environmental factors. While FIGS. 4A-5 and the corresponding description provides one way of calculating a disturbance vector 226 to account for all environmental factors, other methods are available for determining the disturbance vector 226 and are within the scope of the present disclosure. For example, the disturbance vector 226 may be determined based on environmental sensor data (e.g., via environmental sensors 70 are configured to measure air and/or water speed). Alternatively or additionally, the disturbance vector 226 may be determined based on weather data or third party data provided to the system 11. In still other embodiments, the disturbance vector value 226 may be provided to the system 11, such as received from a third party.

Referring now to FIG. 6, the speed through water can be calculated based on the total disturbance vector 226 and the GPS-determined SOG. The disturbance vector 226 represents the net force exerted on the marine vessel 1 by forces such as wind, waves, tides, currents, as a non-limiting list of examples. The speed through water (STW) can then be calculated by finding the difference between the SOG and the disturbance vector 226. If there is no disturbance or the resultant vector is zero, such as if the marine vessel 1 is at rest in the middle of a lake, then SOG=STW. The STW may be greater than the constant trajectory. For example, if the disturbance vector 226 mainly represents a current and tailwind that are moving the same direction as the marine vessel 1, then the STW may be greater than the SOG. A STW of this nature would cause the eccentric range display to present an eccentric range shape 215 around the marine vessel 1 that is greater in directions parallel to the disturbance vector 226 than directions that are either perpendicular or opposite the direction of this disturbance vector 226.

Figure 7A:
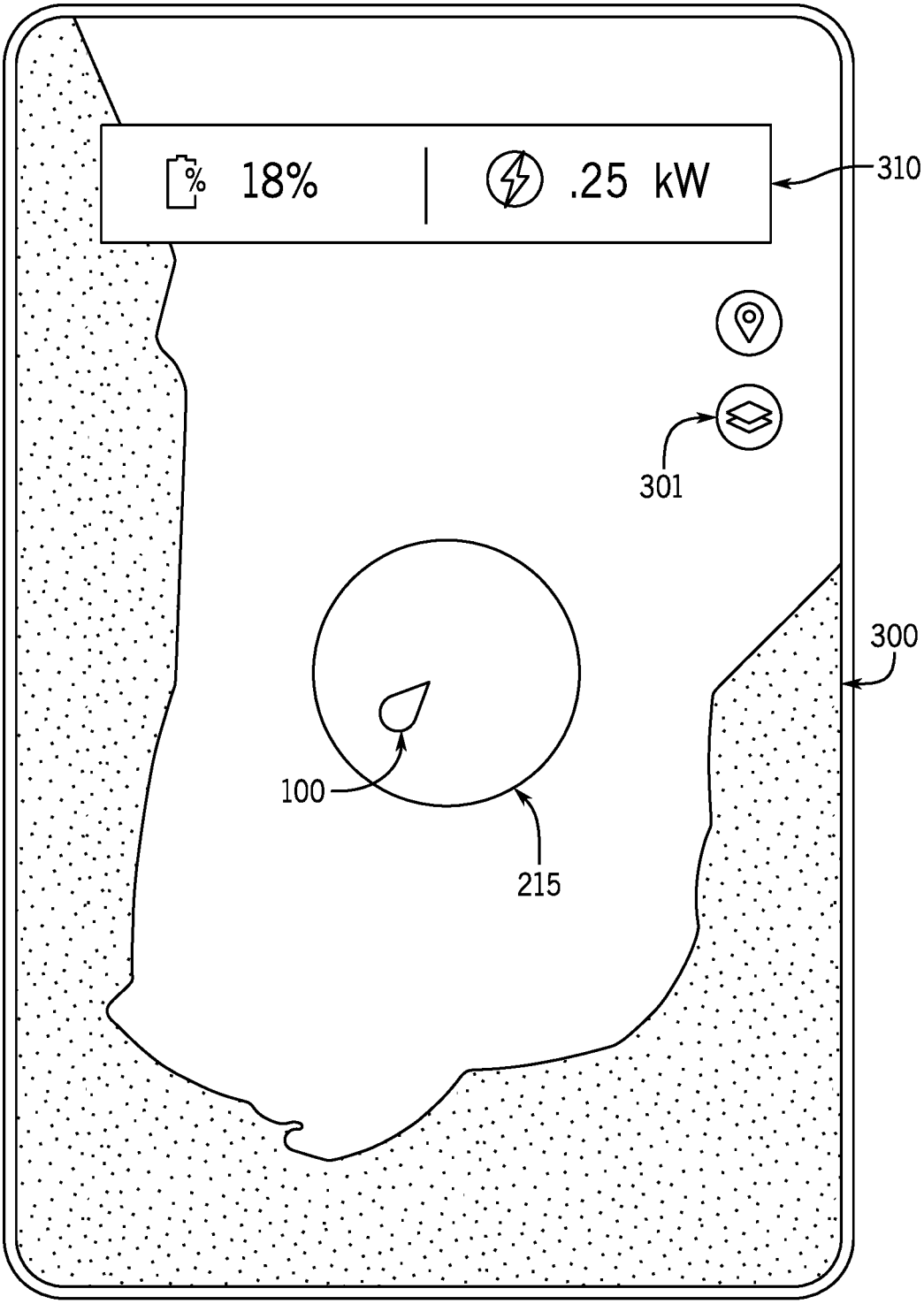
FIGS. 7A-7C, 8, and 9 illustrate embodiments of an exemplary eccentric range display in accordance with the present disclosure.
Figure 7B:
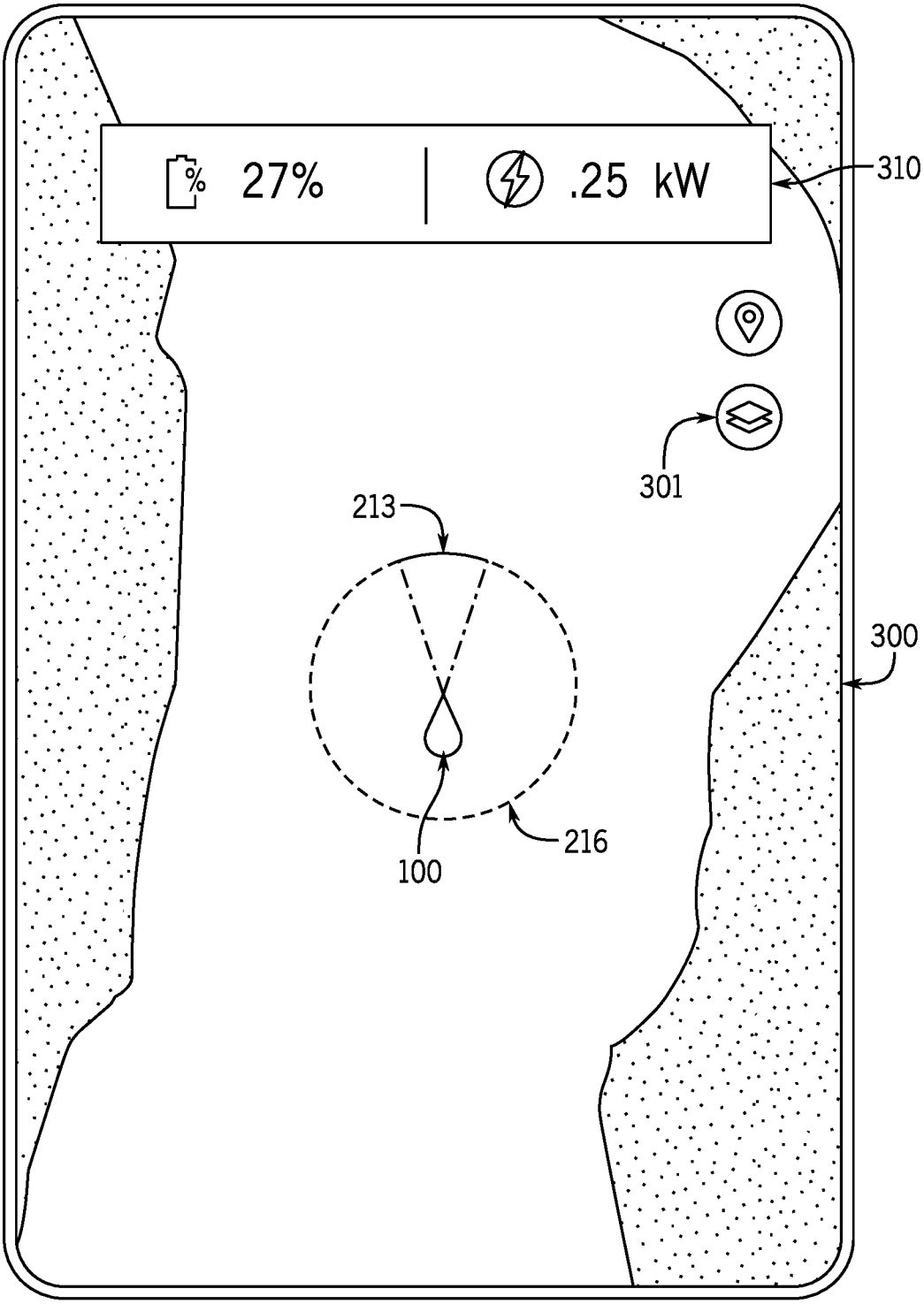
Figure 7C:
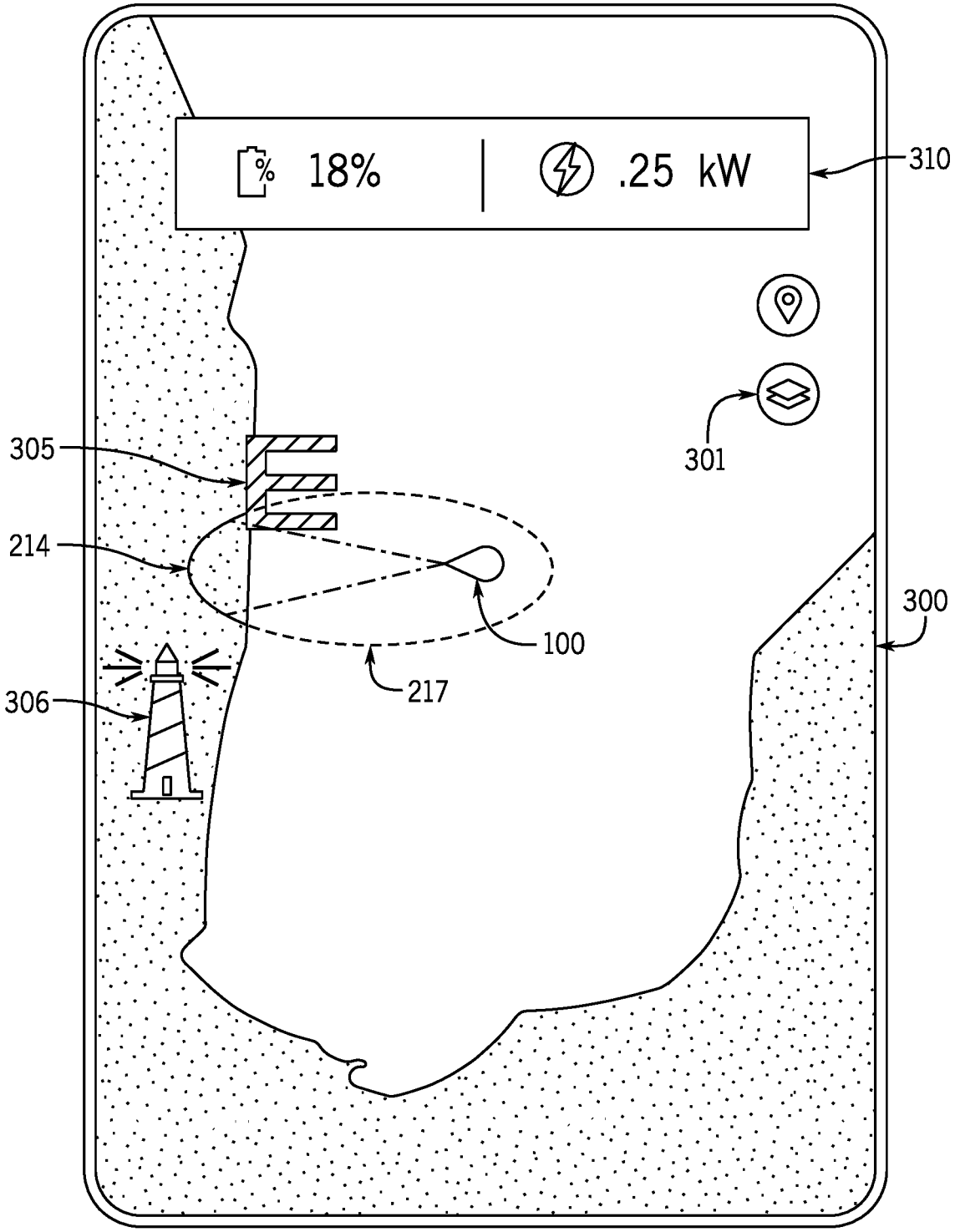

Referring now to FIGS. 7A-C, embodiments of visual interfaces of an exemplary eccentric range display are illustrated. The eccentric range may be displayed to the user in various ways exemplified herein, which will be evident to a person of ordinary skill in the art based on the disclosure and examples provided herein. In addition to the examples at FIGS. 7A-7C and 8-9, the eccentric range display may present interfaces illustrating the eccentric range calculations, or portions thereof, to the user, such as incorporating aspects illustrated in FIG. 3, 4A, 4B, 5, or 6, or any combination thereof. In some implementations, the eccentric range display may comprise components of the referenced Figures to compile novel visual representations of eccentric range. The user interface system 35 may provide an interactive or adjustable eccentric range display insomuch that the user may select components or features to view as part of the eccentric range display.

The eccentric range display may be updated in real time. The eccentric range display may updated at a predetermined refresh rate, wherein the visual portrayed on the user interface system 35 replaces one or more previous velocity datapoints 265 with the most recently received velocity datapoints 265.

In some embodiments, the eccentric range display 300 may comprise a representation of the current vessel location of the marine vessel 1. In some implementations, the range of the marine vessel 1 may be illustrated by an eccentric range shape 213-217. In some embodiments, the eccentric range shape 213-217 may be overlayed on a secondary visual such as a topographical or nautical map. Thereby, the eccentric range display 300 may visually convey the eccentric range to the operator of the marine vessel 1 with respect to landmarks or destination points. As an example, by observing the existing eccentric range shape 213-217 overlayed on a map, the operator of the marine vessel 1 may deduce that the power storage system will not have enough power to return to shore at the current conditions (present power utilization of the propulsion system 2 and disturbance vector 226 magnitude, as examples). The operator may then be enabled to adjust the present power utilization accordingly.

The position of the marine vessel 1 within the eccentric range shape 213-217 may change in real-time as the eccentric range calculation changes, such as when the marine vessel changes heading, present power utilization, power mode, speed, or encounters different environmental forces 65 that alter the calculated resultant vector or as the disturbance vector value 226 changes.

The eccentric range display 300 may provide one or more range indicators 310 that may quantify the marine vessel 1 graphic portrayed within the eccentric range display 300. In some implementations, the range indicators 310 may provide metrics such as the amount of charge remaining in the power storage system 16, the amount of power left in the marine drive 3, the current power output of the marine propulsion system 2, or any combination thereof, as a non-limiting list of examples.

The eccentric range display 300 may comprise at least one selection input 301 to select a different eccentric range display. The selection input 301 may allow the user to switch between visual interfaces that may provide different information to the user. As an example, the user may switch between one or more of the eccentric range displays 300 exemplified in any of the examples provided to better understand the current range or the accuracy and reliability of the calculation.

FIG. 7A exemplifies one embodiment of an eccentric range display 300 where the position of the marine vessel 1 is represented as vessel marker 100 within the eccentric range shape 215 that surrounds the vessel marker 100 to visually depict the eccentric range all directions around the vessel marker 100. Referring now to FIG. 7B, the eccentric range shape 216 may be based on a limited number of velocity datapoints 265. The limited number of velocity datapoints 265 may provide an eccentric range shape 213 that conveys the eccentric range in only a subset of directions around the marine vessel, such as a range of directions around the vessel's current heading direction. In some implementations, a fully encompassing eccentric range shape 216 that conveys the range in all remaining directions may be estimated based on the partial eccentric range shape 213 around the vessel marker 100, such as a best fit shape that matches with the limited number of velocity datapoints 265. In some aspects, the partial eccentric range shape 213 may comprise a sufficient number of velocity datapoints 265, wherein the velocity datapoints 265 are closely grouped together in a small range of heading directions. As an example, if a marine vessel 1 is traveling down a narrow river and has little room to transverse the river or make significant changes in heading, the positional datapoints 260 recorded on the movement path 250 that correlate with the velocity datapoints 265 may be closely grouped in terms of velocity, position, or both. In some embodiments, the eccentric range may require at least heading distribution of at least a 60 to 90 degree arc to provide an accurate eccentric range shape 213-217. In some implementations, the eccentric range display may provide an indication of the limitations of the current eccentric range shape 213, 216. For example, the eccentric range display may show the estimated/abstracted portions of the encompassing eccentric range shape 216 as a dotted line to indicate that it lacks enough information for a full determination of those portions of that eccentric range shape 216.

Referring now to FIG. 7C, a graphic representation of an eccentric range display 300 is illustrated. In some implementations, system 11 may be configured or enabled to, where appropriate, determine calculation of a non-circular eccentric range shape 217, such the oval shape illustrated here or having one or more uneven or asymmetrical portions. The uneven portions may result from concentrated or geographically-isolated environmental forces 65, such as an isolated channel of wind or current that results from a geographical formation and that distorts an otherwise symmetrical and circular eccentric range shape. In some embodiments, the range shape 217 may be further based on additional data, such as tabulated tide tables and/or maps estimating current or wind speeds, can be used to augment the calculated disturbance vector 226. This would be helpful in generating a graphical display in a situation where the vessel's direction of movement is constrained and where environmental forces can vary significantly in a small location, such as between islands or where inlets connect rivers and coastal areas. In some implementations, the eccentric range display 300 may comprise one or more destination markers 305, 306. The destination marker 306 may represent a waypoint, a GPS point of interest such as common destinations or well-known landmarks, or a user-inputted destination, as non-limiting examples. The eccentric range shape 214 may thus indicate the feasibility of arriving at a destination marker 305, 306 with the present settings of the marine propulsion system 2, even if the total eccentric range shape 217 lacks sufficient data to be calculated with accuracy. In some embodiments, similar to the circumstances presented in the river example illustrated in the descriptions for FIG. 7B, the eccentric range shape 214, 217 may be, at least in part, influenced by the range of direction of the marine vessel 1, such as a range of heading directions clockwise and counterclockwise from the current heading direction. The range of heading directions accounted for in the eccentric range calculation may be a predetermined range centered about the current heading direction, or may account for a plurality of heading directions, such as including the heading directions of the marine vessel over a predetermined time period or an average heading direction over a current trip.

For example, if the marine vessel 1 is headed towards a specific destination marker 305, the change in heading from the current direction may be sufficiently minor to group the velocity datapoints 265 tightly, thereby only providing the accuracy of a known eccentric range shape 214 in the current direction of motion. In some implementations, the eccentric range display 300 may provide selectable methods of manually determining which destination markers 305 are presented on the eccentric range display 300.

Figure 8:
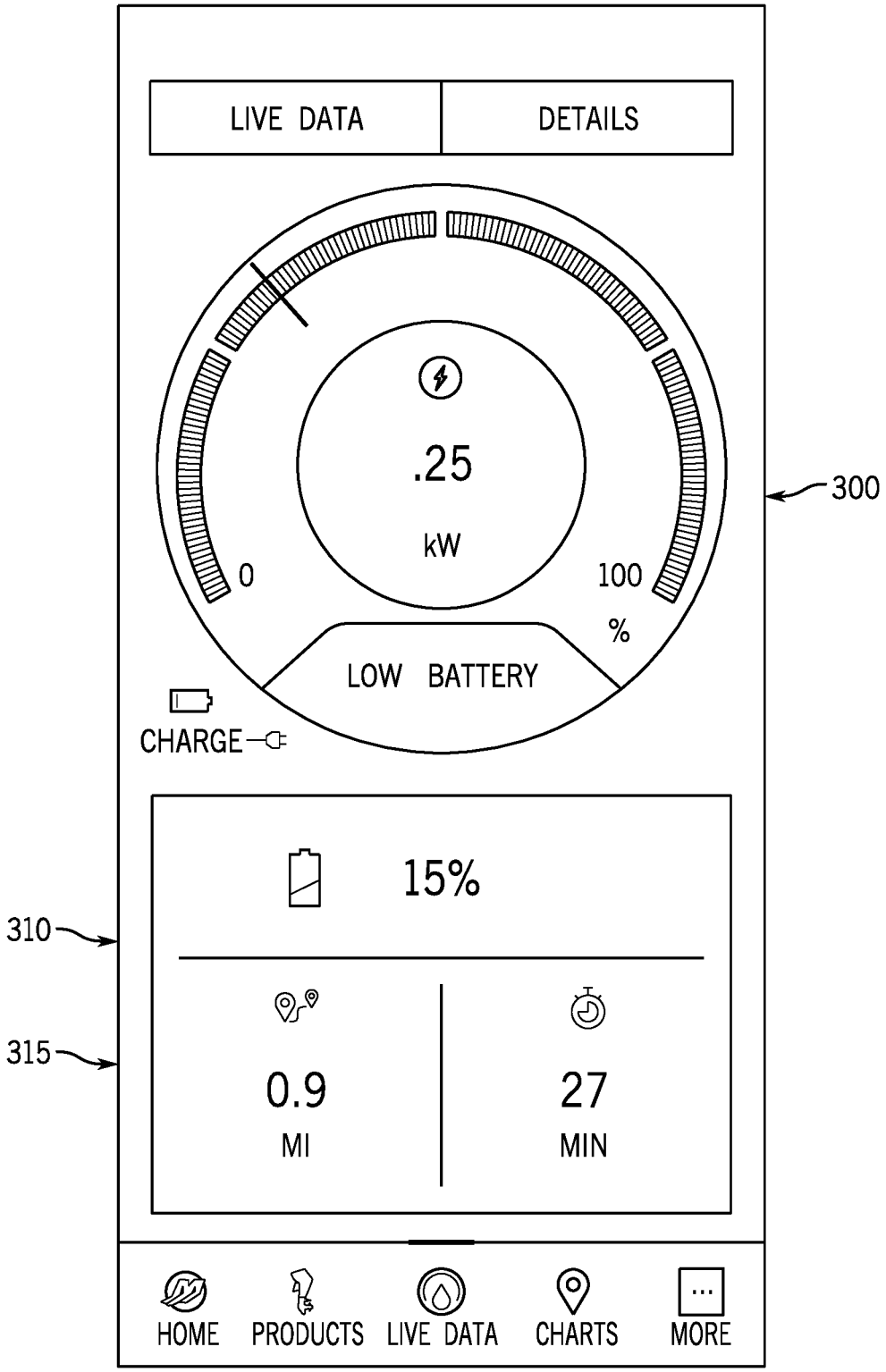
Figure 9:
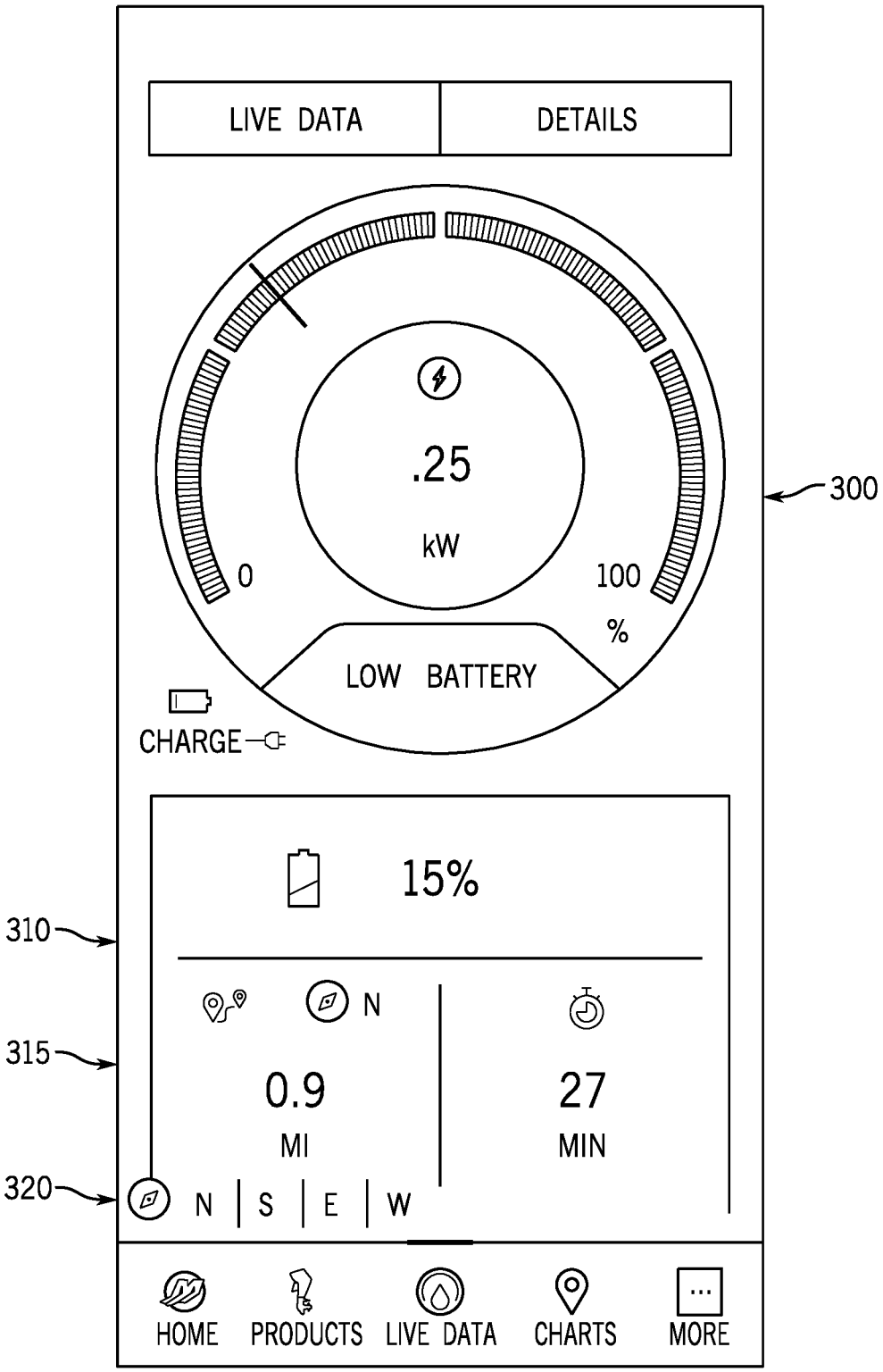

Referring now to FIG. 8, another embodiment of a visual interface of an exemplary eccentric range display 300 is illustrated. As illustrated here, the range indicators 310 comprise numeric representations of the eccentric range, such as the estimated miles remaining, the total time remaining, the present or remaining power output, the percent of battery charge remaining, or any combination thereof, as a non-limiting list of examples. In some aspects, these numeric indicators may be displayed with reference to a current heading, and may adjust the eccentric range display when the heading changes or when the user selects a different direction option 320 to be displayed in the eccentric range display area 315 of the display 300. As illustrated in FIG. 9, the eccentric range display 300 may comprise one or more selectable direction options 320 for range indication. Thereby, the eccentric range display area 315 can be selectably adjusted by the user to display the range to empty in any one of a plurality of different heading directions around the current vessel location. The eccentric range display area 315 thereby enables the user to gauge the effects of environmental forces on range and plan the trip accordingly. The direction options 320 are illustrated here as cardinal directions (North, South, East, West). Alternatively, the eccentric range display may be configured to provide selectable direction options 320 based on the current heading direction, such as +/−90 degrees and 180 degrees from the current heading direction.

Figure 10:
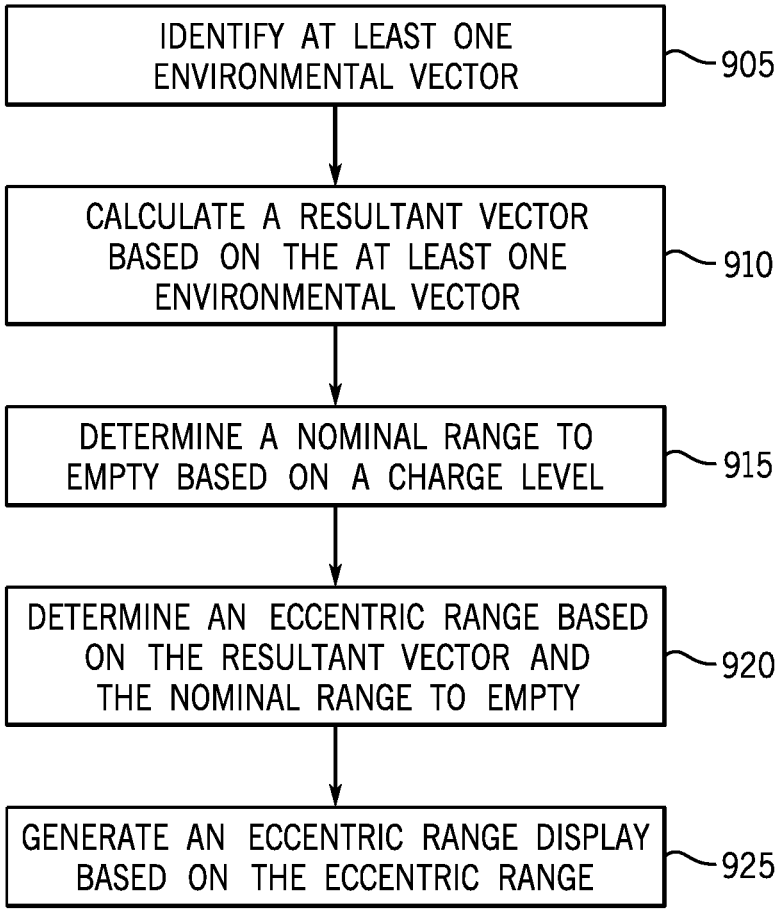
FIGS. 10-11 are flow charts demonstrating exemplary methods of calculating an eccentric range in accordance with the present disclosure.

FIG. 10 depicts one embodiment of a method of calculating an eccentric range and generating an eccentric range display. At step 905, the control system identifies at least one environmental vector. As described herein, the environmental vector may be based on sensed environmental measurements. Alternatively, the environmental vector may be calculated based on GPS and propulsion outputs over time. In still other embodiments, the environmental vector may be obtained from or determined based on external sources, such as weather data and/or current maps. A resultant vector is determined at step 910 based on the environmental vector(s). The resultant vector may represent a net force from a plurality of environmental forces on the marine vessel and may be determined based on environmental vectors, or in other embodiments may be identified by other means. A nominal range to empty (nominal RTE) is determined at step 915, such as based on a charge level of the power storage system (such as based on the operating batteries) and one or more present operating parameters of the propulsion system, such as a vessel speed or other speed parameter. An eccentric range is then determined at step 920 based on the nominal RTE and the resultant vector, wherein the eccentric range represents a range to empty in a plurality of directions around the marine vessel. For example, the eccentric range may represent the range to empty in the current direction of travel of the marine vessel and in each of a plurality of different directions other than the current direction of travel. For instance, the eccentric range may represent the range to empty in a range of heading directions clockwise and counterclockwise from the current heading direction. Alternatively or additionally, the eccentric range may represent the range to empty in each of a current heading direction of the marine vessel, a heading direction 90 degrees from the current heading direction, a heading direction 180 degrees from the current heading direction, and a heading direction 270 degrees from the current heading direction. Alternatively or additionally, the eccentric range may represent the range to empty in each of a plurality of cardinal directions, such as each of the north, south, east, and west heading directions. An eccentric range displayed is then generated and displayed, such as on display device 40 at the helm of the vessel, to communicate the eccentric range to the operator.

Figure 11:
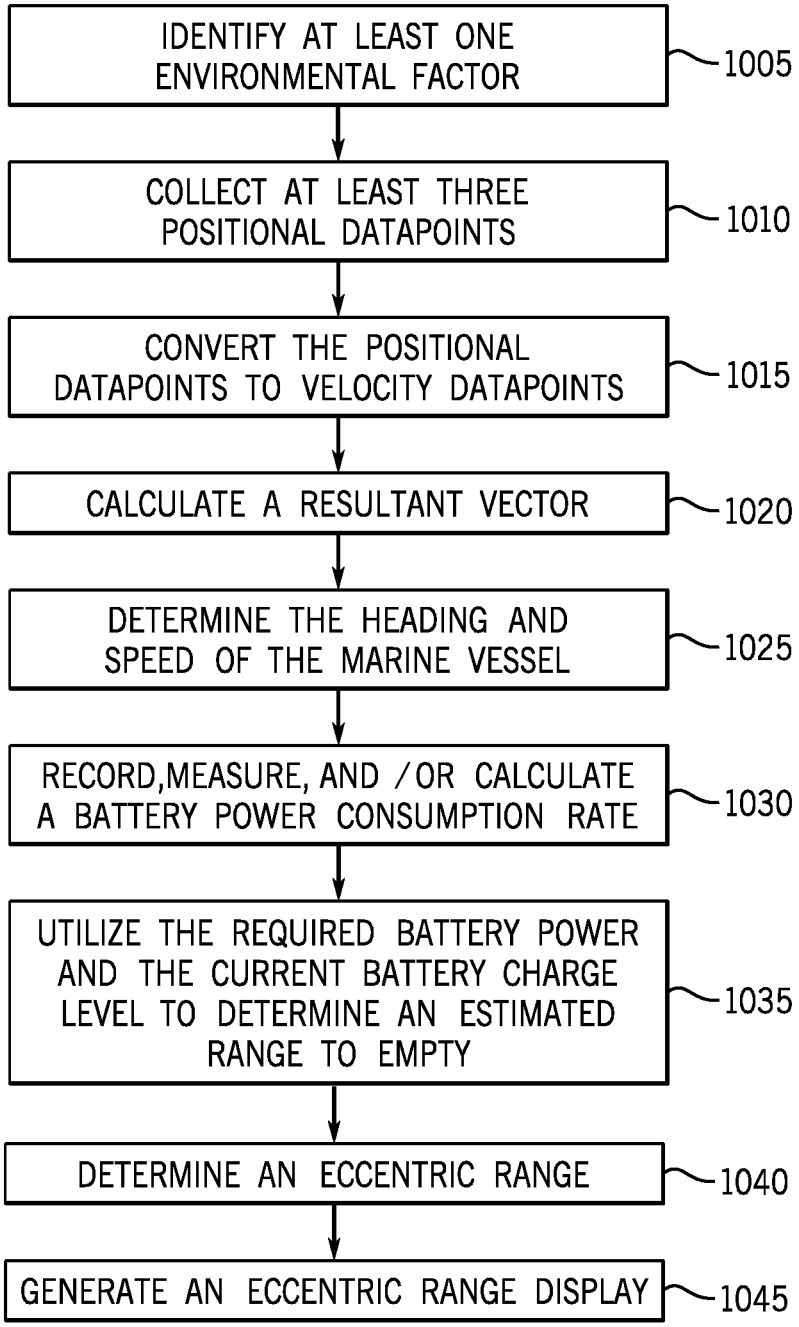

Referring now to FIG. 11, an exemplary method of calculating an exemplary eccentric range and eccentric range display is illustrated. At 1005, at least one environmental vector is identified describing a magnitude and direction of the at least one environmental factor impacting a marine vessel. At 1010, at least three positional datapoints are collected, wherein the at least three positional datapoints are generated by: activating a data recording device when activated by a control system; recording the magnitude and direction of the at least one environmental force when a constant trajectory is measured for a minimum time; and, at 1015, converting the at least three positional datapoints into at least three velocity datapoints.

At 1020, a resultant vector is calculated from the at least three velocity datapoints, or a disturbance vector is otherwise determined or obtained, wherein the resultant vector indicates the net force from the at least one environmental vector exerted upon the marine vessel. At 1025, a heading and speed of the marine vessel is determined. At 1030, the control system 11 records, measures, and/or calculates a battery power consumption rate of the marine vessel 1 at the current heading and speed.

At 1035, the current battery power consumption rate and the current battery charge level of the power storage system powering at least one propulsion device are utilized to generate an estimated range to empty at the current heading and speed of the vessel. Alternatively, the estimated range to empty may be a nominal range to empty determined and outputted by the battery controller or by some other controller based on the battery parameters over a period of time. At 1040, an eccentric range is determined providing an estimated range to empty in each of a plurality of directions based on the resultant vector and/or disturbance vector, the estimated range to empty, and the current battery charge level. At 1045, a visual interface of an estimated eccentric range to empty is generated based on the eccentric range, such as depicted as an eccentric range shape.

A number of embodiments of the present disclosure have been described. While this specification contains many specific implementation details, these should not be construed as limitations on the scope of any disclosures or of what may be claimed, but rather as descriptions of features specific to particular embodiments of the present disclosure.

Certain features that are described in this specification in the context of separate embodiments can also be implemented in combination or in a single embodiment. Conversely, various features that are described in the context of a single embodiment can also be implemented in combination in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous.

Moreover, the separation of various system components in the embodiments described above should not be understood as requiring such separation in all embodiments, and it should be understood that the described program components and systems can generally be integrated together in a single software product or packaged into multiple software products.

Thus, particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order show, or sequential order, to achieve desirable results. In certain implementations, multitasking and parallel processing may be advantageous. Nevertheless, it will be understood that various modifications may be made without departing from the spirit and scope of the claimed disclosure.

What is claimed is:

1. An electric marine propulsion system for a marine vessel comprising:

a power storage system comprising at least one battery;

an electric marine drive powered by the power storage system;

a control system configured to:

identify at least one environmental vector describing a magnitude and a direction of at least one environmental force impacting a marine vessel;

calculate a resultant vector based on the at least one environmental vector;

determine a nominal range to empty based on a charge level of the power storage system and at least one present operating parameter of the electric marine propulsion system;

determine an eccentric range based on the resultant vector and the nominal range to empty, wherein the eccentric range represents a range to empty in a plurality of directions around the marine vessel, wherein the plurality of directions include at least one of a current heading direction of the marine vessel, a heading direction 90 degrees from the current heading direction, a heading direction 180 degrees from the current heading direction, and a heading direction 270 degrees from the current heading direction; and generate an eccentric range display based on the eccentric range; and control a display device on the marine vessel to display the eccentric range display.

2. The system of claim 1, wherein the eccentric range display includes an eccentric range shape representing a distance to empty in the plurality of directions from a current position of the marine vessel.

3. The system of claim 2, wherein the eccentric range display includes a circle representing the distance to empty in all directions around the marine vessel.

4. The system of claim 3, wherein the circle represents an asymmetric range around the current position of the marine vessel.

5. The system of claim 2, wherein the eccentric range display represents the eccentric range shape on a map of an area around the marine vessel.

6. The system of claim 1, wherein the eccentric range display represents the range to empty in the plurality of directions including the current heading direction of the marine vessel and a range of heading directions clockwise and counterclockwise from the current heading direction.

7. The system of claim 1, wherein the eccentric range represents the range to empty in at least the current heading direction of the marine vessel and the heading direction 180 degrees from the current heading direction.

8. The system of claim 1, wherein the eccentric range is an arc representing a distance to empty in the plurality of directions, wherein the plurality of directions includes the current heading direction of the marine vessel.

9. The system of claim 1, wherein the nominal range to empty is determined based on a reported time to empty (reported TTE) from each of the at least one battery and/or a battery current received from each of the at least one battery.

10. The system of claim 1, wherein the at least one environmental force impacting the marine vessel includes current and/or wind.

11. A method of monitoring a battery range for an electric marine propulsion system comprising a power storage system powering at least one propulsion device, the method comprising:

identifying a resultant vector describing a magnitude and a direction of one or more environmental forces impacting a marine vessel;

determining a nominal range to empty based on a charge level of the power storage system and at least one present operating parameter of the electric marine propulsion system;

determining an eccentric range based on the resultant vector and the nominal range to empty, wherein the eccentric range represents a range to empty in a plurality of directions around the marine vessel, wherein the plurality of directions include at least one of a current heading direction of the marine vessel, a heading direction 90 degrees from the current heading direction, a heading direction 180 degrees from the current heading direction, and a heading direction 270 degrees from the current heading direction; and generating an eccentric range display based on the eccentric range; and controlling a display device on the marine vessel to display the eccentric range display.

12. The method of claim 11, wherein the eccentric range display represents a distance to empty in the plurality of directions, which includes the current heading direction of the marine vessel and a range of heading directions clockwise and counterclockwise from the current heading direction.

13. The method of claim 11, wherein the eccentric range represents the range to empty in at least the current heading direction of the marine vessel and the heading direction 180 degrees from the current heading direction.

14. The method of claim 11, wherein the eccentric range display includes a circle representing the range to empty in all directions around the marine vessel.

15. The method of claim 14, wherein the circle is asymmetric around a current position of the marine vessel.

16. The method of claim 11, wherein the eccentric range display includes an arc representing the range to empty in the plurality of directions, wherein the plurality of directions includes a current heading direction of the marine vessel.

17. The method of claim 11, further comprising updating the eccentric range display in real-time based on a change in nominal RTE and/or a change in the resultant vector due to a change in the one or more environmental forces.

18. The method of claim 11, further comprising updating the eccentric range display in real-time based on a change in current heading direction of the marine vessel and/or a change in the heading direction of the one or more environmental forces relative to the current heading direction of the marine vessel.

19. The method of claim 11, wherein the one or more environmental forces impacting the marine vessel include current and/or wind.

20. The method of claim 11, wherein the resultant vector indicates a net force from a plurality of environmental forces on the marine vessel.

* * * * *